United States Patent [19]

Sword et al.

[11] 4,199,672

[45] Apr. 22, 1980

[54] APPARATUS FOR CURING COATINGS ON WELDED LONGITUDINAL SEAMS OF CAN BODIES

[76] Inventors: Carl V. Sword, 1322 Evergreen Rd., Homewood, Ill. 60430; Frank E. Halicki, 10609 S. Keeler Ave., Oak Lawn, Ill. 60453; Edward G. Geiss, 9020 S. 84th St., Hickory Hills, Ill. 60457

[21] Appl. No.: 850,349

[22] Filed: Nov. 10, 1977

[51] Int. Cl.[2] ..... H05B 9/02; H05B 5/08

[52] U.S. Cl. ..... 219/9.5; 219/8.5; 219/10.49 R; 219/10.79; 219/10.53

[58] Field of Search ..... 219/10.49, 9.5, 8.5, 219/7.5, 10.41, 10.43, 10.53, 10.57, 10.79, 10.71, 10.69, 10.67, 10.75

[56] References Cited

U.S. PATENT DOCUMENTS

| | | | |
|---|---|---|---|
| 2,475,348 | 7/1949 | Black | 219/9.5 |
| 2,532,460 | 12/1950 | Phillips | 219/10.49 |
| 2,535,836 | 12/1950 | Cameron et al. | 219/9.5 |
| 2,732,473 | 1/1956 | Ellsworth | 219/10.75 |
| 2,818,483 | 12/1957 | Blume | 219/8.5 |
| 3,027,443 | 3/1962 | Reed et al. | 219/10.53 |
| 3,431,382 | 3/1969 | Esche et al. | 219/10.75 |
| 3,632,948 | 1/1972 | Moulin | 219/10.79 |
| 3,840,138 | 10/1974 | Mohr | 219/9.5 |

*Primary Examiner*—C. L. Albritton
*Assistant Examiner*—Philip H. Leung
*Attorney, Agent, or Firm*—Fay & Sharpe

[57] ABSTRACT

Can bodies having welded longitudinal seams with a heat curable coating thereon are carried longitudinally past an induction heater for curing the coating. The induction heater includes first and second stages for respectively rapidly heating the seams to coating curing temperature and then holding the seams at such temperature for a curing period.

5 Claims, 11 Drawing Figures

APPARATUS FOR CURING COATINGS ON WELDED LONGITUDINAL SEAMS OF CAN BODIES

BACKGROUND OF THE INVENTION

This application relates to the art of can manufacture and, more particularly, to curing of coatings applied to longitudinal seams on can bodies.

The application is particularly applicable for use in curing coatings applied to welded longitudinal seams of cylindrical can bodies and will be particularly described with reference thereto. However, it will be appreciated that the invention has broader aspects and may be used for localized longitudinal heating of other bodies and may be used for purposes other than curing coatings.

Can bodies are commonly manufactured by taking flat rectangular metal blanks having a coating on one surface thereof except in the area at the edges of the blanks which will be overlapped and welded because welding requires absolutely clean metal for good bonding. The welded longitudinal seams are then coated with either liquids or powders to protect the contents of the ultimate containers from contamination by bare metal and to protect the integrity of the containers themselves from possible damage by the container products.

It is very common to use coatings such as vinyl, epoxys and phenolics in liquid form and to apply such coatings by spray heads at suitable stations on a machine. Air drying of the coating is very time consuming and often does not result in a highly protective, impervious coating. It would be desirable to have an apparatus for heating the longitudinal seams in a highly efficient manner for heat curing coatings applied to the welded longitudinal seams.

SUMMARY OF THE INVENTION

Can bodies having welded longitudinal seams with a heat curable coating thereon are carried longitudinally past induction heating means for heating the seams and curing the coating. The induction heating means includes first and second stages for respectively rapidly heating the seams to coating curing temperature and then holding the seams at such temperature for a curing period.

In one arrangement, the induction heating means includes a split return coil longitudinally separated into short and long split return coil sections respectively defining the first and second stages. The long split return coil section has a length at least twice the length of the short split return coil section.

In one arrangement, the can bodies travel along a longitudinal axis and the short split return coil section is spaced outwardly from that axis a greater distance than the long split return coil section.

Carrier means is provided for carrying the can bodies past the induction heating means with the welded longitudinal seams facing upwardly. The induction heating means is positioned above the can bodies for heating the upwardly facing seams as the can bodies move longitudinally therebeneath.

An exhaust hood is positioned above the induction heating means for exhausting vapors liberated during curing of the coating on the seams. The hood includes side panels on opposite sides of the hood extending downwardly past the induction heating means.

The carrier means for longitudinally carrying the can bodies includes a support frame and suspension supports are secured to that support frame for suspending the induction heating means above the carrier means.

The induction heating means includes a split return coil having a center coil leg and opposite side coil legs. The coil legs have surfaces facing toward the can bodies and lying generally on the periphery of a common circle. Spacers of dielectric material are positioned between the center coil leg and the side coil legs. The spacers have spacer surfaces facing toward the can bodies and penetrating the common circle so that can bodies tending to engage the coil legs are prevented from doing so by the spacer surfaces.

The short coil leg surfaces may be spaced further from the spacer surfaces than the long coil leg surfaces. This arrangement provides a longitudinally stepped coil wherein the short coil section which rapidly heats the can bodies to curing temperature is spaced radially outwardly from the can bodies a greater distance than the long coil section which maintains the can bodies at coating curing temperature.

The induction heating means in the form of a split return coil is mounted on a suspension support including a base having a pair of angle members secured thereto. A coil mounting member is secured between the angle members and has longitudinally spaced transverse openings therethrough and longitudinally spaced brackets secured to opposite sides thereof. The coil includes center and opposite side coil legs having threaded studs projecting therefrom. The studs on the center coil leg extend through holes in the mounting member and into the openings therein and the studs on the side coil legs extend through the mounting brackets. Nuts are received in a retaining relationship on the respective studs.

One advantage of the present invention is the provision of an improved apparatus for curing coatings on welded longitudinal seams of can bodies.

Another advantage of the invention is the provision of an apparatus which is very economical to manufacture and assemble.

Still another advantage of the invention is the provision of an apparatus with an improved exhaust hood having hinged side panels.

A further advantage of the invention is the provision of an apparatus which heats longitudinal seams in a very economical and efficient manner.

An additional advantage of the invention is the provision of an improved induction heating coil for heating welded longitudinal seams on can bodies for curing coatings.

Other advantages and benefits will become apparent to those skilled in the art upon a reading and understanding of the specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF A PREFERRED EMBODIMENT

Figure 1:
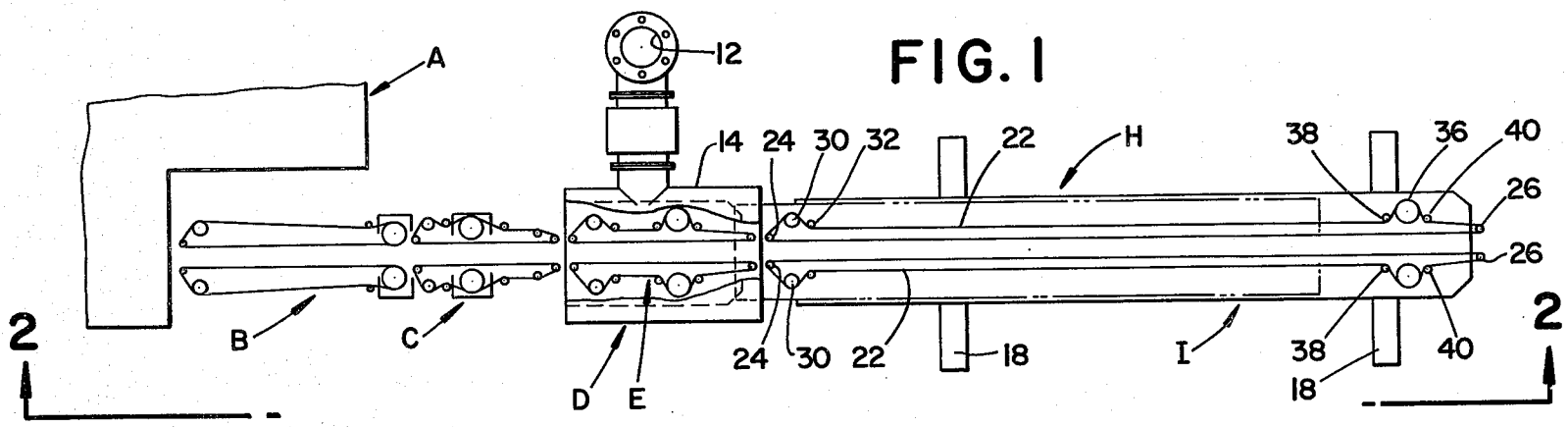
FIG. 1 is a diagrammatic partial top plan view of an apparatus constructed in accordance with the present invention with portions omitted for ease of illustration.

Referring now to the drawings wherein the showings are for purposes of illustrating the preferred embodiment of the invention only and not for purposes of limiting same, FIG. 1 shows a welding apparatus A for welding longitudinal seams on cylindrical can bodies. The welded can bodies are discharged from apparatus A with their welded longitudinal seams facing vertically upwardly. Apparatus A may be of several known types and does not form a specific part of the present invention so that further detailed elaboration is not necessary to permit those skilled in the art to practice the concepts of the present invention. The can bodies are fed by feed devices B and C to an inside spray device D of a known type for applying a heat curable coating to the inside surface of the welded longitudinal seams on the can bodies. Inside spray apparatus D includes a feed device E for feeding can bodies therethrough and an air exhaust duct 12 connected with a hood 14. The can bodies with a heat curable coating applied to the inside surfaces of the welded longitudinal seams are fed from inside spray apparatus D to a coating curing apparatus H constructed in accordance with the present invention. The coating applied to the inside surfaces of the welded longitudinal seams by apparatus D may be any suitable type including heat curable vinyls, epoxies and phenolics. Moreover, any desirable coating capable of suitably covering the welded seam and curable by heat may also be advantageously employed.

Curing apparatus H includes carrier means I for carrying can bodies longitudinally with their welded longitudinal seams facing vertically upward. In one arrangement, carrier means I includes a carrier support frame having suitable support legs 18. The support frame movably supports opposed continuous flexible belts 22 between which the can bodies are gripped for passage through apparatus H. Driven belts 22 extend around opposite input and discharge idler rolls 24,26. Adjacent input rolls 24, belts 22 extend around staggered guide idler rollers 30,32. Adjacent discharge idler rollers 26, belts 22 extend around rotatably driven drive rollers 36, and drive idler rollers 38,40. Elongated guide rails, shown at 46 in FIG. 3, extend between rollers 32,38 in FIG. 1 outside of the long runs of belts 22 to prevent fluttering of the belts and otherwise guide them in substantially linear paths as they are driven by drive rollers 36. Belts 22 are driven for moving can bodies from left to right as viewed in FIG. 1.

It will be appreciated that a coating apparatus similar to inside coating apparatus D can be provided adjacent to discharge idler rollers 26 for coating the outside surfaces of the welded longitudinal seams. Downstream of the outside seam coating apparatus, an additional curing apparatus may be provided similar to curing apparatus H. A final can marker and discharge table may then be provided further downstream for the completed can bodies.

A large exhaust hood 48 is positioned in vertically-spaced relationship above carrier means I and has an outlet 50 suitably connected with a blower for exhausting vapors liberated by curing apparatus H while the coating on the welded longitudinal seams is curing.

Figure 2:
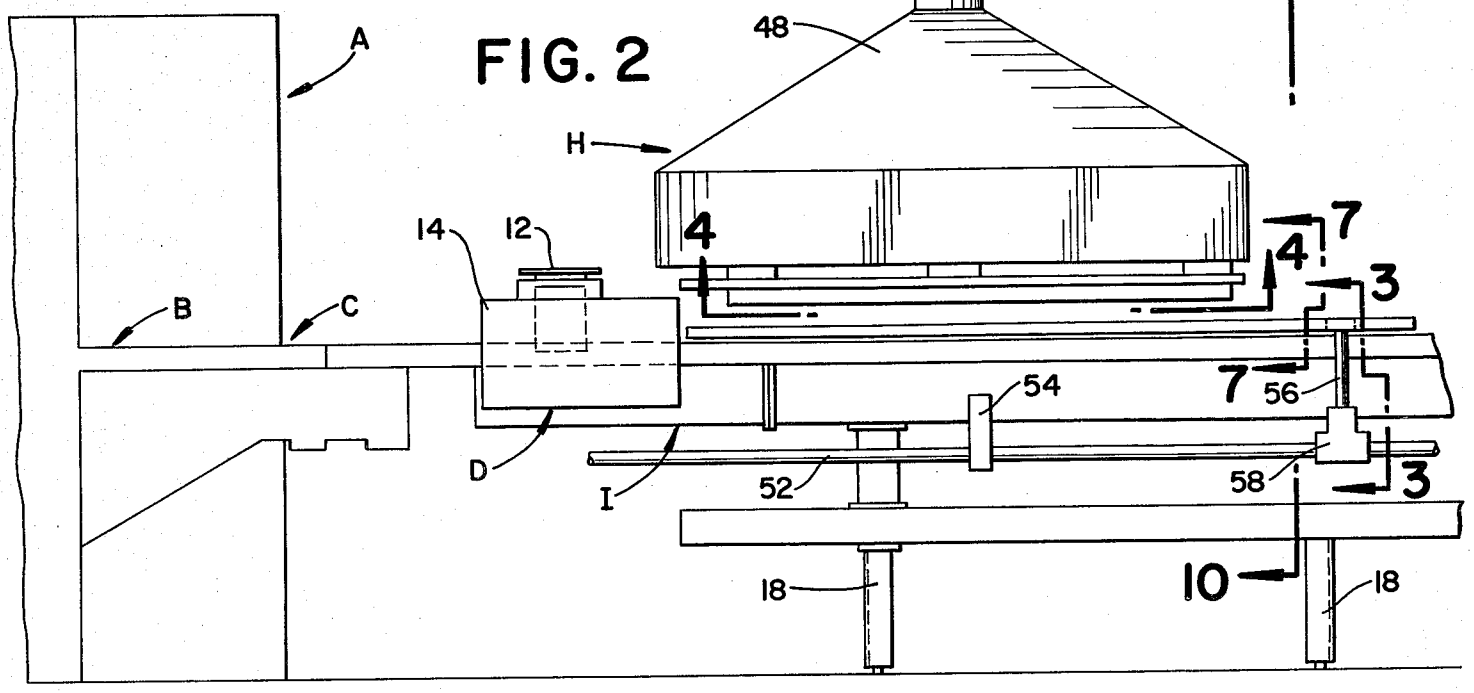
FIG. 2 is a diagrammatic partial side elevational view taken generally along lines 2—2 of FIG. 1 with portions omitted for ease of illustration.
Figure 3:
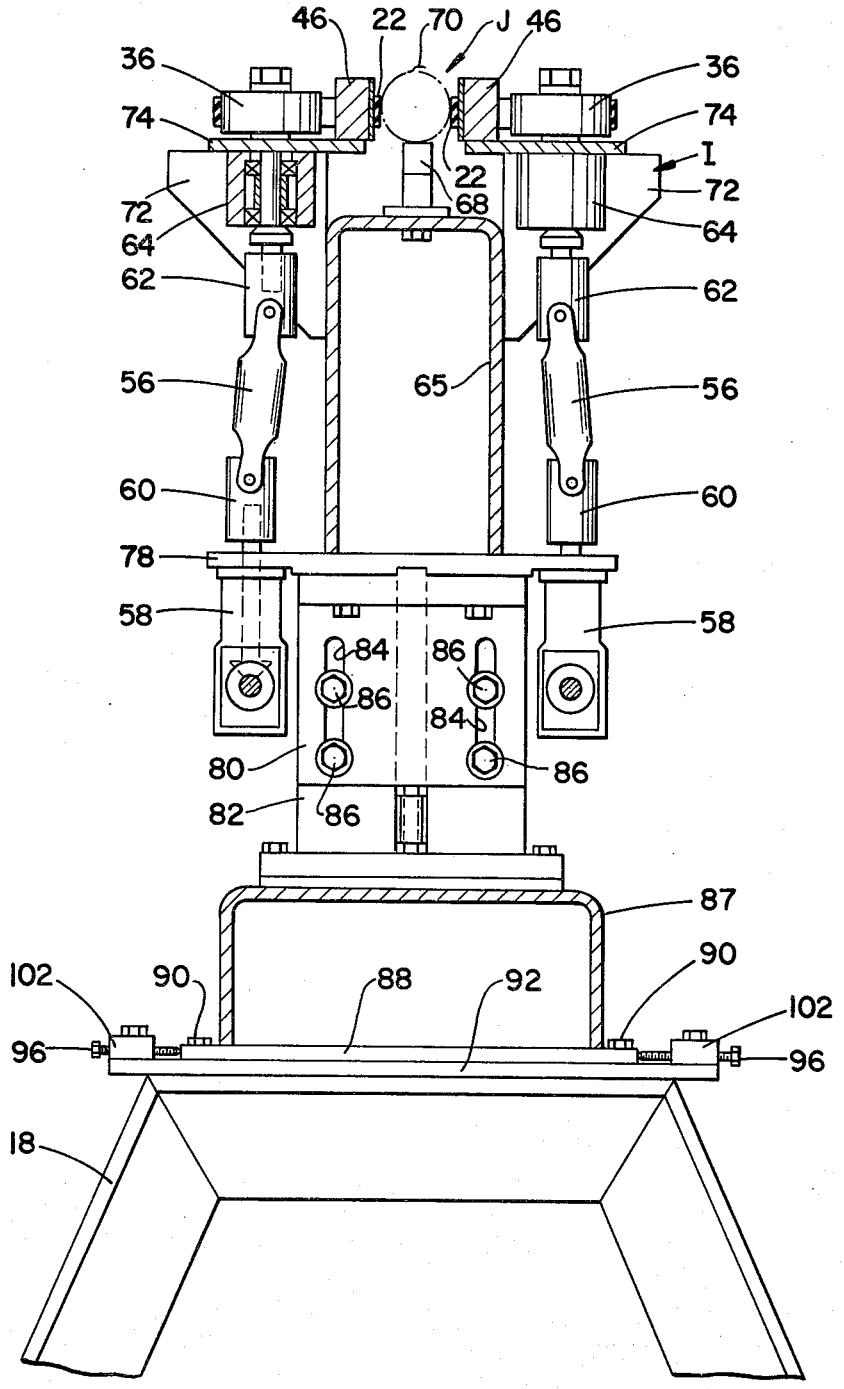
FIG. 3 is a partial cross-sectional elevational view taken generally along lines 3—3 of FIG. 2.

As shown in FIG. 2, elongated horizontal drive shafts 52 extend along opposite sides of the carrier support frame and are rotatably mounted as on suitable brackets 54. Drive shafts 52 drivingly engage vertical drive shafts 56 through suitable right angle drives 58. As best shown in FIG. 3, vertical drive shafts 56 are pivotally connected at their lower ends with drive shafts 60 from right angle drives 58 and at their upper ends to drive shafts 62 extending through suitable bearings 64 and drivingly connected with drive rollers 36. The carrier support frame for carrier means I includes a beam 65 supporting a suitable bottom guide rail 68 centrally located beneath the elongated central runs of belts 22. Elongated bottom guide rail 68, or its equivalent, is provided along the full length of the carrier means and other feed devices. FIG. 3 shows an elongated cylindrical can body J with its welded longitudinal seam 70 facing upward. Suitable plates 72 are welded to beam 65 at longitudinally-spaced intervals and support horizontal plates 74 on which guide rails 46 and drive roller bearings 64 are supported.

The bottom of beam 65 is secured to a plate 78 suitably bolted to overlapping brackets 80, 82 having aligned vertical slots 84 therethrough receiving bolt and nut assemblies 86. Bracket 82 is suitably bolted to a beam member 87 welded to a plate 88 having bolts 90 extending through holes therein and into transverse slots in a lower plate 92 welded to legs 18. Plate 88 is transversely adjustable by rotating adjustment bolts 96 which extend through adjustment bolt brackets 102 suitably bolted to plate 92. This allows proper vertical and transverse positioning of bottom guide rail 68.

Figure 4:
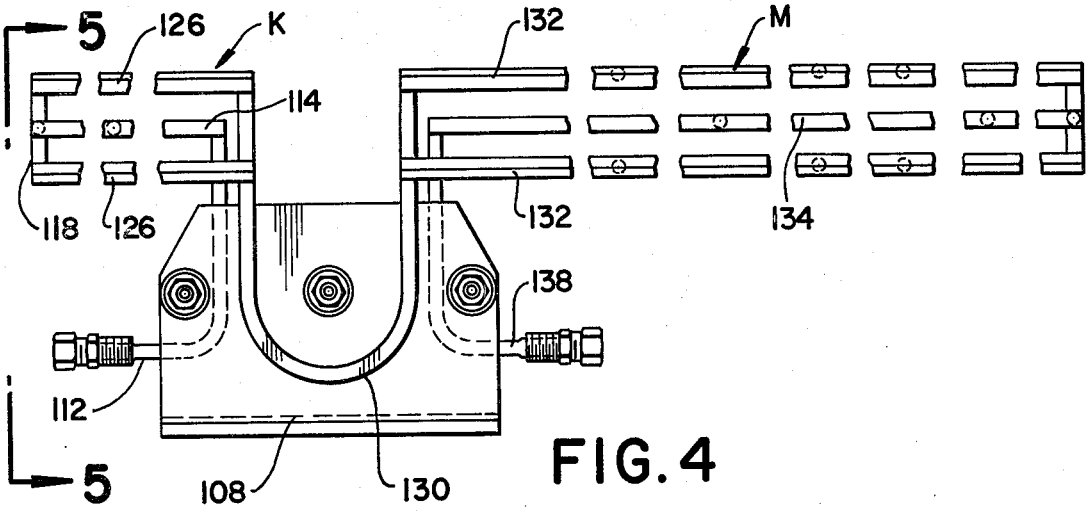
FIG. 4 is a bottom plan view taken generally along lines 4—4 of FIG. 2, and with a suspension support omitted for ease of illustrating the induction coil.

An induction heating means is suspended above carrier means I directly beneath hood H for heating welded longitudinal seams of the can body and curing the coating thereon. This induction heating means takes the form of an induction heating coil best shown in FIGS. 4–6 and includes first and second stages respectively defined by longitudinally-spaced short and long coil sections K and M. A connector fitting 108 has a hollow conductor 112 leading to center leg 114 of short coil section K and this center coil is connected by a center vertical leg 116, base leg 118 and opposite vertical legs 120 with opposite side coil legs 126. The facing surfaces of legs 114 and 126 which face toward the can body are flat. Opposite side legs 126 are turned inwardly so that lines expending perpendicular to the outer facing surfaces of side coil legs 126 intersect one another at an included angle of approximately 60°. Connector fitting 108 also includes convenient means (not shown) for operably connecting the induction heating coil to an RF generator (not shown) or the like in a manner known in the art. Since the RF generator itself as well as the interconnection thereof to the coil are known to those skilled in the art and do not form a specific part of the present invention, they are not specifically shown or described herein.

Figure 5:
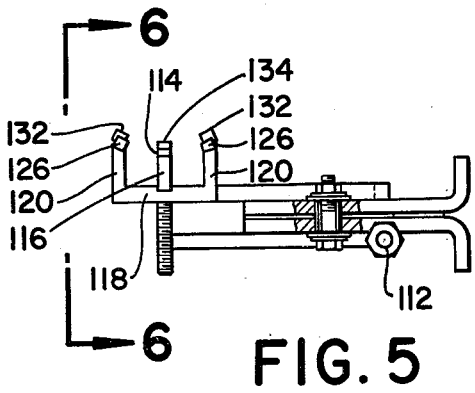
FIG. 5 is an end elevational view taken generally along lines 5—5 of FIG. 4.
Figure 6:
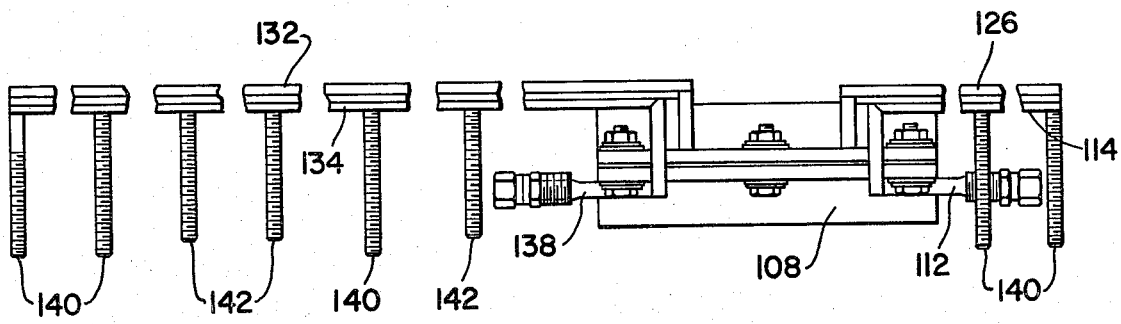
FIG. 6 is a side elevational view taken generally along lines 6—6 of FIG. 5.

A transfer coil section 130 extends from the inner ends of side coil legs 126 to the inner ends of opposite long side coil legs 132 of long coil section M. Long side coil legs 132 are suitably connected at their outer ends with center coil leg 134 which is connected at its inner end with connecting conductor conduit 138. The flat facing surfaces of long coil legs 132,134 are positioned similarly to those on short coil legs 114,126. However, short and long coil sections K and M may be stepped as best shown in FIGS. 5 and 6 so that the flat outer surfaces of short coil section K are below the flat outer facing surfaces of the coil legs on long coil section M. The flat outer facing surfaces of short coil legs 114,126 lie on the periphery of a common reference circle and this circle is pierced by long coil legs 132,134. In other words, the facing surfaces on the coil legs of short coil section K are positioned radially further away from the can bodies than the corresponding facing surfaces on the coil legs of long coil section M.

It will be appreciated that all of the coil legs are in fluid communication with one another, to permit a flow of cooling water therethrough as is conventional in the induction heating art from a cooling water source or supply (not shown). The main electrical current from an RF generator or the like is provided such that it flows through the center coil legs and returns by the side coil legs. This provides maximum eddy currents along the welded longitudinal seams and minimizes the heating effect of the eddy currents produced by the side coil legs. Threaded mounting studs 140 are secured to center coil legs 114,134 and corresponding studs 142 are secured to long side coil legs 132.

Figure 7:
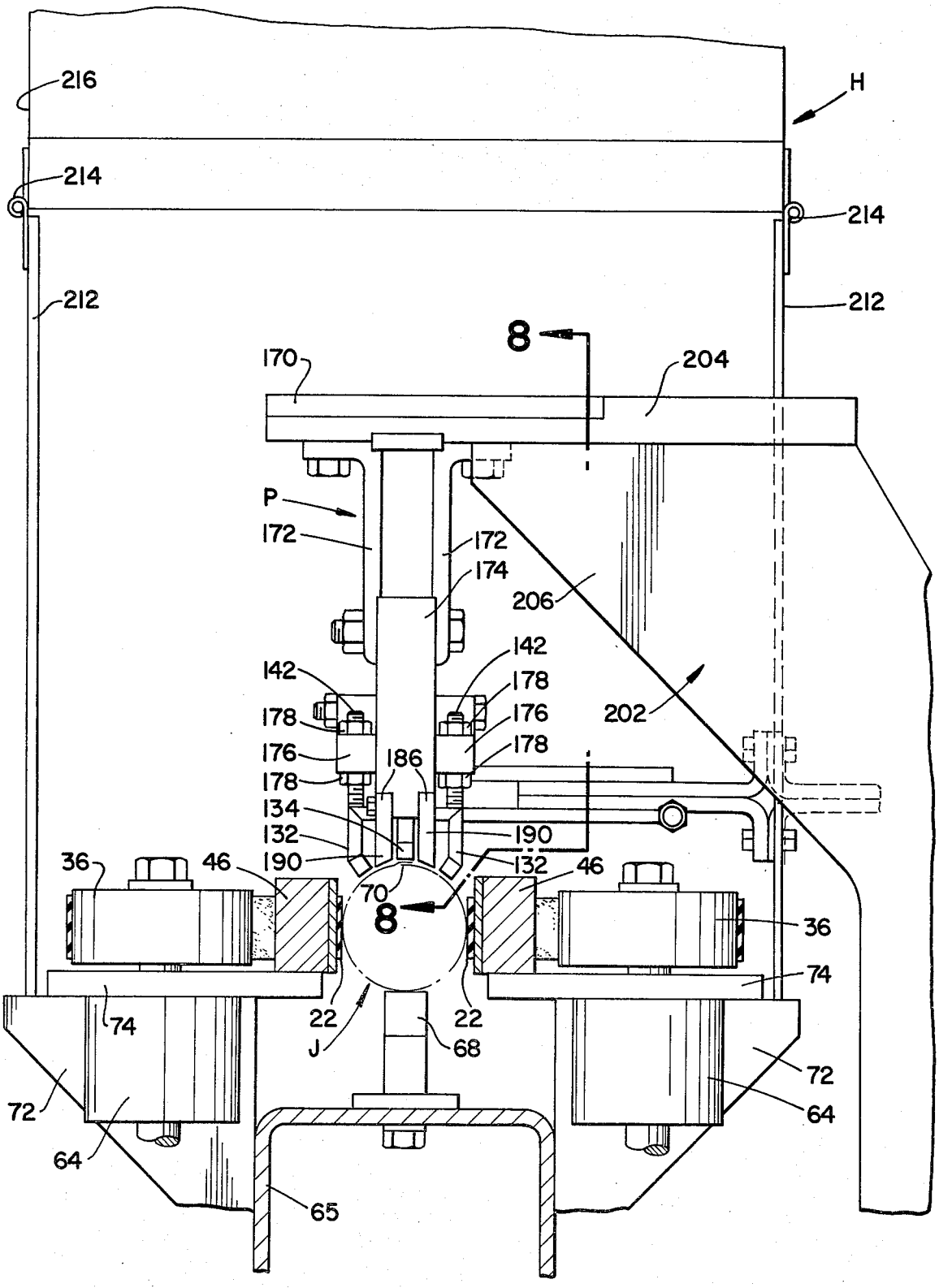
FIG. 7 is a partial end elevational view taken generally along lines 7—7 of FIG. 2.
Figure 8:
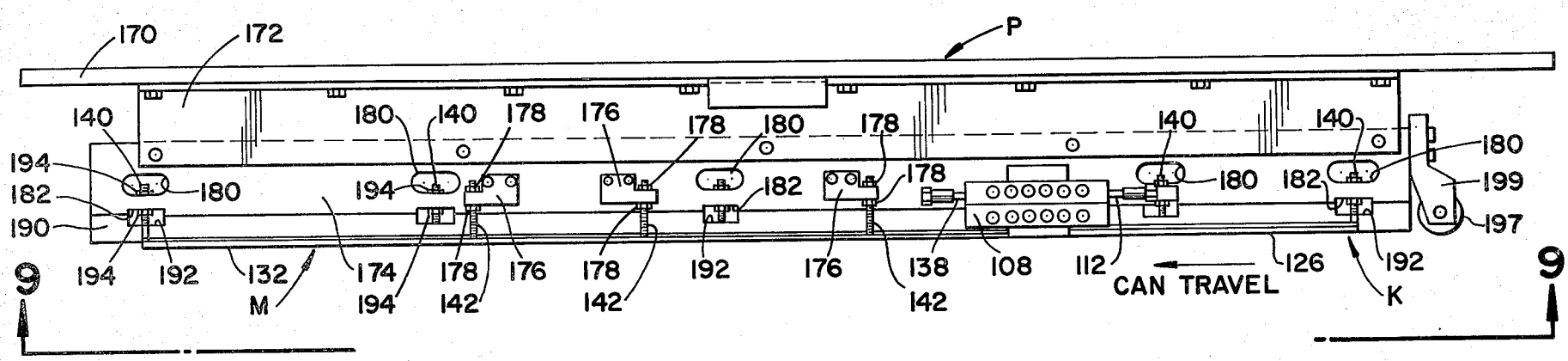
FIG. 8 is a side elevational view taken generally along lines 8—8 of FIG. 7.
Figure 9:
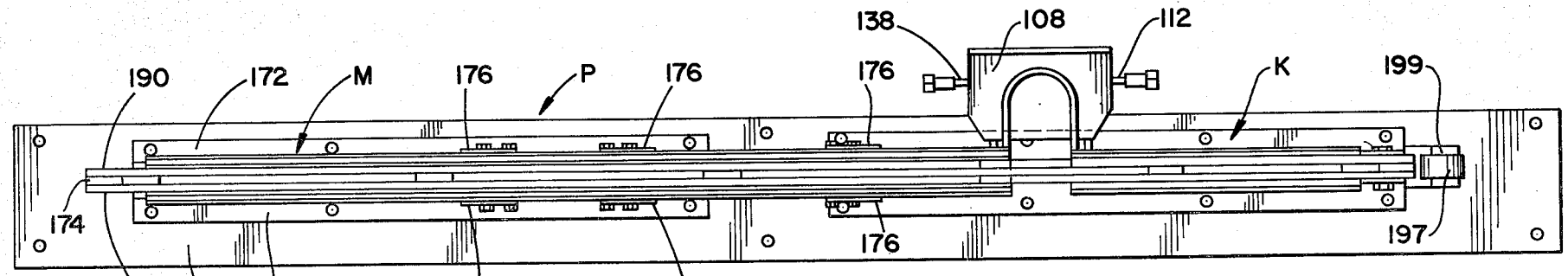
FIG. 9 is a bottom plan view taken generally along lines 9—9 of FIG. 8.

As best shown in FIGS. 7–9, suspension means P is provided for suspending the induction heating means above the carrier means for heating the welded longitudinal seams on the can bodies as they pass beneath the induction heating means. An elongated flat base member 170 has transversely-spaced angle members 172 suitably bolted thereto, and a central mounting member 174 suitably bolted between the free legs of angle members 172. Mounting member 174 has suitable mounting brackets 176 secured to the opposite side faces thereof at longitudinally-spaced intervals for receiving studs 142 on long side coil legs 132. Opposed adjustment nuts 178 are threaded on studs 142 on the opposite sides of brackets 176.

A plurality of longitudinally-spaced transverse openings 180 are provided in central mounting member 174 intermediate the free ends of angle members 172 and the free outer end of mounting member 174. Notches 182 in the free outer end of mounting member 174 are aligned with transverse openings 180. As shown in FIG. 7, the free outer end of central mounting member 174 has longitudinal rabbets 186 formed therein for receiving elongated spacers 190 of suitable dielectric material such as ceramic or the like. Suitable bolts extend through suitable transverse holes in spacers 190 and mounting member 174 for securing same in position. Spacers 190 are notched as at 192 in alignment with notches 182. Studs 140 on center coil legs 114 and 134 extend through suitable holes in central mounting member 174 and into openings 180. Suitable adjustment nuts 194 are provided on studs 140, in notches 182,192 and in openings 180 for adjustably securing same in position.

The facing outer surfaces of spacers 190 which face can body J as shown in FIG. 7 lie on the periphery of a predetermined reference circle. The facing surfaces of the coil legs on the short coil section K are spaced further radially outwardly from this reference circle than are the facing surfaces of the coil legs on long coil section M. However, the facing surfaces of both coil sections are spaced outwardly from this reference circle so that any tendency for can bodies J to contact the induction coil legs is prevented by spacers 190. An alternative way of viewing this is to define the facing surfaces of the coil legs on long coil section M as lying on the periphery of a common circle which is pierced by spacers 190. The outer facing surfaces of spacers 190 extend along straight lines the full length of the induction heating means. Short and long coil sections K and M are stepped as clearly shown in FIGS. 5, 6 and 8. Spacers 190 shown in FIG. 7 are positioned between the center coil legs and the opposite side coil legs but do not contact same. These items are spacers primarily only in the sense that they will maintain the can bodies from contacting the outer facing surfaces of the coil legs.

Short coil section K rapidly heats the welded longitudinal seams up to curing temperature and the can bodies then pass through the space between the coil sections. The welded longitudinal seams are then maintained at the coating curing temperature as they pass beneath long coil section M which is at least two times as long as short coil section K and preferably, approximately 3 times as long. The short coil section K is spaced outwardly from the axis or path along which the can bodies travel a distance greater than the spacing therefrom of long coil section M.

As shown in FIG. 8, deflector means in the form of a roller 197 is provided for deflecting can bodies beneath the induction heating means as such bodies travel from right to left in FIG. 8. Roller 197 is mounted to member 174 of suspension means P by a vertically adjustable bracket 199 at the entry end of the induction coil. Roller 197 is located between inside spray apparatus D and curing apparatus H of FIG. 2. Bracket 199 is preferably adjusted to locate roller 197 slightly closer to the can bodies than spacers 190 so the leading end of a can body cannot hang up on the end of spacers 190.

Figure 10:
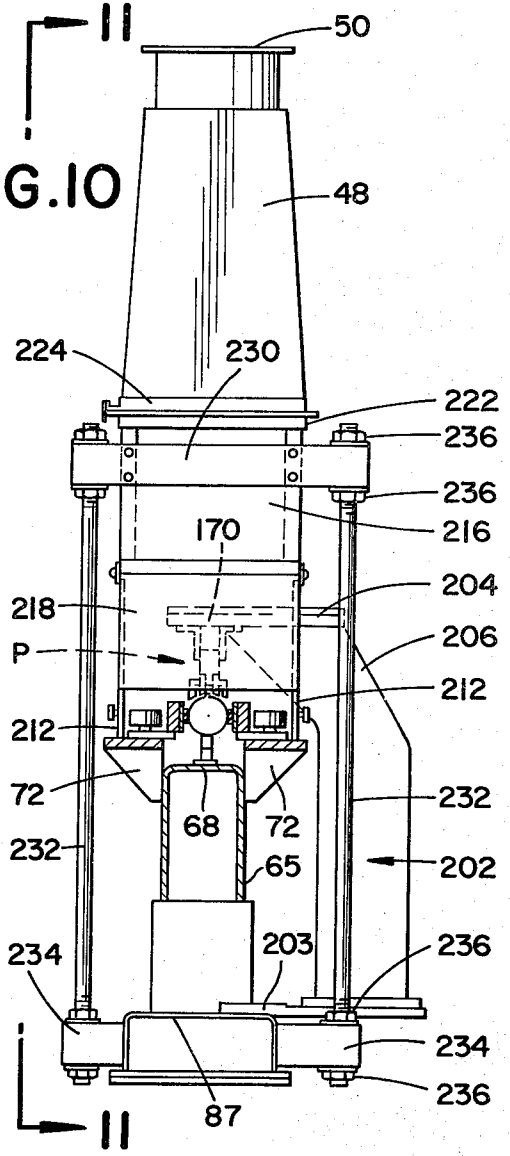
FIG. 10 is a cross-sectional elevational view taken generally along lines 10—10 of FIG. 1; and, FIG. 11 is a side elevational view taken generally along lines 11—11 of FIG. 10.

As best shown in FIGS. 7 and 10, a plurality of spaced upright supports 202 are secured to one side of the frame of the carrier means as by plates 203 welded or bolted to beam 87 and have horizontal support portions 204 at the top of inwardly inclined portions 206. Base member 170 forming part of the suspension support for the induction heating means is suitably bolted to horizontal portions 204 for suspending the induction coil assembly above the carrier means closely beneath hood 48.

Figure 11:
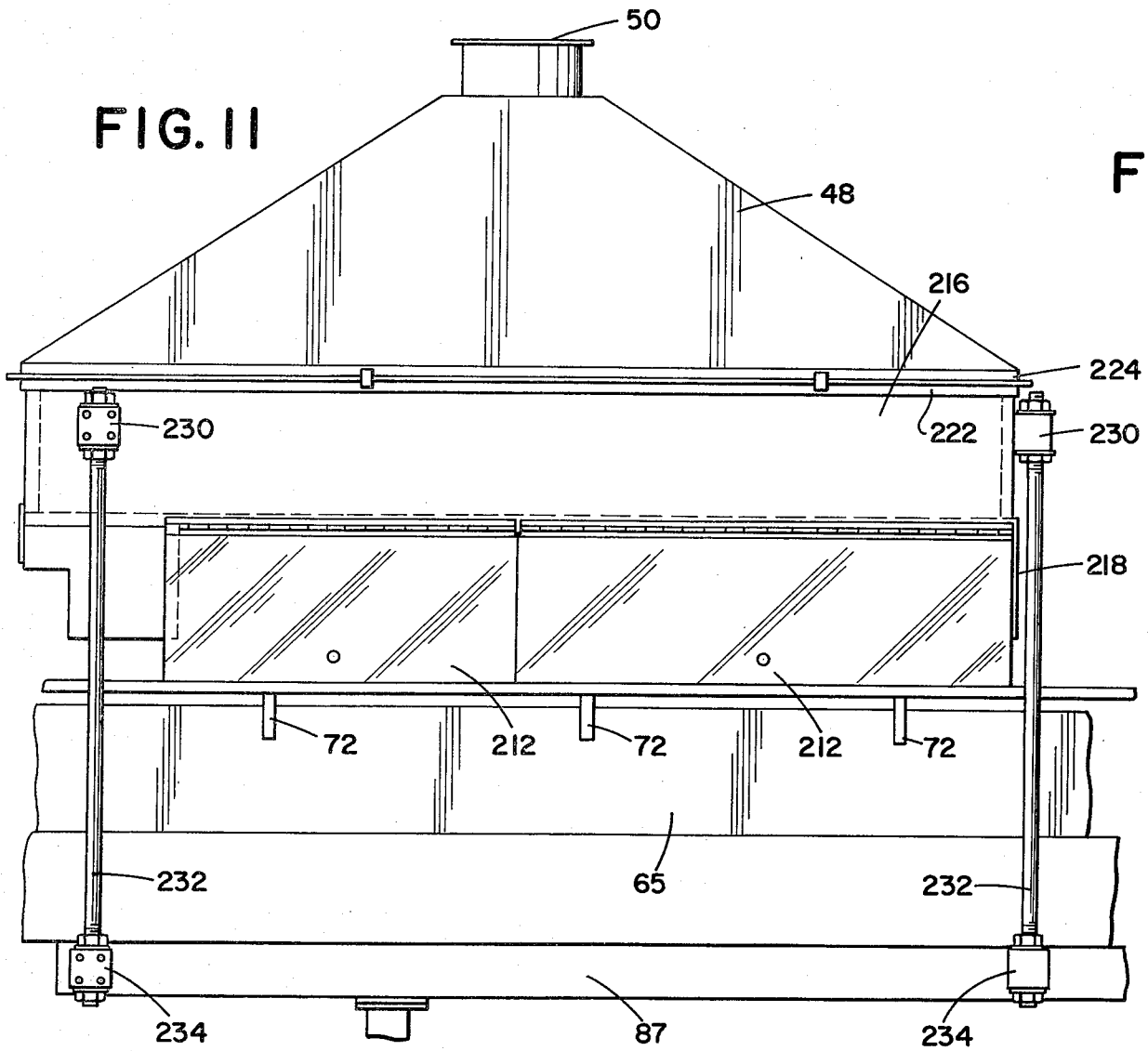

As best shown in FIGS. 7, 10 and 11, opposite elongated side panels 212 are suitably connected as by piano hinges 214 to the bottom of an extension 216 on hood 48 and extend downwardly past the opposite sides of the induction heating means to plates 74. This substantially confines vapors liberated during curing of the coating so that the vapors are exhausted through exhaust hood 48. Hinged panels 212 are preferably substantially transparent and may be made of suitable break resistant material such as acrylic. Panels 212 extend downwardly on opposite sides of the can bodies. End panels 218 are suitably secured to the opposite ends of extension 216 and extend downwardly to terminate at lower edges spaced slightly above the can bodies.

Extension 216 has a peripheral frame 222 secured to its upper edge for cooperation with a corresponding frame 224 on the lower peripheral edge of hood 48. Frames 222,224 may have outwardly extending flanges bolted together. Structural members 230 are suitably secured to extension 216 and have suitable vertical holes freely receiving the upper ends of rods 232 defining hood supports. Suitable structural members 234 are secured to beam 87 of the carrier support frame and have suitable vertical holes receiving the lower ends of rods 232. Nuts 236 are threaded onto rods 232 on the opposite sides of structural members 230,234 for adjustment purposes. This arrangement adjustably suspends hood 48 above the carrier means by upright hood supports mounted on the carrier support frame. Side panels 212 move hingedly between generally vertical and horizontal positions for access to the induction heating means.

On the side of hood 48 on which induction coil supports 202 are located hinged panels 212 are suitably notched or cut-away to clear the supports and the connections from the induction coil to an RF generator and a cooling apparatus (both not shown). It is also possible to have only the outer panels 212 opposite from supports 202 hinged if so desired.

The invention has been described with reference to the preferred embodiment. Obviously, modifications and alterations will occur to others upon a reading and understanding of this specification. It is intended that all such modifications and alterations will be included insofar as they come within the scope of the appended claims or the equivalents thereof.

Having thus described the invention, it is now claimed:

1. Apparatus for heating welded longitudinal seams on can bodies for curing coatings applied to the seams, said apparatus comprising:

an elongated split return induction coil having center and opposite side legs and being longitudinally separated into short and long coil sections, said coil legs having facing surfaces which face toward can bodies to be heated; elongated spacers of dielectric material positioned between said center and side coil legs in nonengaging transversely-spaced relationship thereto, said spacers having spacer surfaces facing toward the can bodies to be heated and being positioned closer to the can bodies than said facing surfaces of said coil legs; and, said spacers and spacer surfaces extending in straight lines the length of said coil and spanning the longitudinal space between said short and long coil sections.

2. The apparatus as defined in claim 1 wherein said induction coil is suspended over a path along which can bodies move longitudinally with said spacer surfaces of said spacers and said facing surfaces of said coil legs facing downwardly, said spacer surfaces and said facing surfaces being substantially flat, said facing surfaces being substantially tangent to a common first circle, and said spacer surfaces being substantially tangent to a common second circle smaller than said first circle.

3. The apparatus as defined in claim 2 including a support for said induction coil, said support including a base, a pair of angle members secured to said base and a mounting member secured between said angle members, said induction coil being secured to said mounting member.

4. The apparatus as defined in claim 3 wherein said coil legs have threaded studs extending therefrom in a direction generally opposite from said facing surfaces thereof, opposite side brackets secured to the opposite sides of said mounting member and having holes receiving said studs on said side coil legs, said studs on said center coil leg extending through holes in said mounting member and projecting into transverse openings in said mounting member, with nuts threaded onto said studs.

5. The apparatus as defined in claim 1 wherein said induction coil has an entry end and deflector means mounted adjacent said entry end for deflecting can bodies beneath said spacer surfaces.

* * * * *

UNITED STATES PATENT AND TRADEMARK OFFICE

CERTIFICATE OF CORRECTION

PATENT NO. : 4,199,672

DATED : April 22, 1980

INVENTOR(S) : Carl V. Sword et al

It is certified that error appears in the above—identified patent and that said Letters Patent is hereby corrected as shown below:

In the patent heading, the following patent assignment data is added following the line identified as [76] Inventor:

Assignee: The Sherwin-Williams Company
Cleveland, Ohio

Signed and Sealed this

*Twenty-second* Day of *July 1980*

[SEAL]

*Attest:*

SIDNEY A. DIAMOND

*Attesting Officer*

*Commissioner of Patents and Trademarks*